US007607418B2

(12) United States Patent
Abe et al.

(10) Patent No.: US 7,607,418 B2
(45) Date of Patent: Oct. 27, 2009

(54) FUEL INJECTION NOZZLE AND METHOD OF HOLDING THE SAME

(75) Inventors: Motoyuki Abe, Hitachinaka (JP); Masahiko Hayatani, Munich (DE); Tohru Ishikawa, Kitaibaraki (JP); Takehiko Kowatari, Kashiwa (JP); Noriyuki Maekawa, Kashiwa (JP); Yasuo Namaizawa, Naka (JP); Yusuke Irino, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/193,433

(22) Filed: Aug. 18, 2008

(65) Prior Publication Data

US 2009/0064972 A1 Mar. 12, 2009

(51) Int. Cl.
*F02M 61/14* (2006.01)

(52) U.S. Cl. ..... 123/470

(58) Field of Classification Search ..... 123/456, 123/468–470
See application file for complete search history.

(56) References Cited

U.S. PATENT DOCUMENTS 3,776,209 A * 12/1973 Wertheimer et al. ..... 123/470
6,289,876 B1 * 9/2001 Mackert ..... 123/470
6,367,813 B1 * 4/2002 Braun et al. ..... 277/630
6,745,956 B1 * 6/2004 Bantle et al. ..... 239/533.3
6,962,142 B2 11/2005 Sekine
7,347,189 B2 * 3/2008 Anello et al. ..... 123/470
7,458,363 B2 * 12/2008 Blank ..... 123/470
7,513,242 B2 * 4/2009 Morris ..... 123/470
2002/0152995 A1 * 10/2002 Kato ..... 123/470
2004/0112338 A1 * 6/2004 Berger et al. ..... 123/468
2006/0021601 A1 * 2/2006 Schmieder ..... 123/468
2007/0113828 A1 * 5/2007 Fonville et al. ..... 123/470
2008/0105236 A1 * 5/2008 Scheffel et al. ..... 123/470
2008/0156298 A1 * 7/2008 Brauneis et al. ..... 123/470
2008/0245340 A1 * 10/2008 Beardmore ..... 123/470

FOREIGN PATENT DOCUMENTS

JP 3385415 B2 1/2003
JP 2005-98275 A 4/2005

* cited by examiner

*Primary Examiner*—Thomas N Moulis
(74) *Attorney, Agent, or Firm*—Crowell & Moring LLP

(57) ABSTRACT

A fuel injection nozzle for directly injecting fuel into a cylinder of an internal combustion engine is inserted in a connecting pipe extending from a fuel rail and is fixed to the connecting pipe by fastening member. The fuel injection nozzle has a sealing part for sealing a fuel passage to prevent fuel leakage, and a contact part in contact with the fastening member. The contact part is softer than the fastening member, and the contact part undergoes plastic deformation when a bending moment that bends the axis of the fuel injection nozzle acts on the fuel injection nozzle.

6 Claims, 7 Drawing Sheets

FUEL INJECTION NOZZLE AND METHOD OF HOLDING THE SAME

BACKGROUND OF THE INVENTION

1. Field of the Invention

The present invention relates to a fuel injection nozzle, for an internal combustion engine, that is needed to be fastened or connected to a high-pressure fuel rail to inject fuel directly into a cylinder.

2. Description of the Related Art

A method of connecting a high-pressure fuel pipe to a device included in a high-pressure fuel system is disclosed in Jpn. Pat. No. 3385415 (Patent Document 1). This method presses a tapered end part of a high-pressure fuel pipe against a tapered fuel port formed in a device included in a high-pressure fuel system by high pressure. The high-pressure fuel pipe is a double-wall pipe having an inner pipe of a stainless steel, and an outer pipe of a soft steel surrounding the inner pipe. An end part of only the outer pipe is pressed against the tapered fuel port so that the end part of the outer pipe undergoes plastic deformation so as to conform to the shape of the tapered fuel port to improve fuel-sealing performance of the joint of the high-pressure fuel pipe and the device of the high-pressure fuel system.

A method of connecting a fuel injection nozzle to a fuel rail disclosed in JP-A 2005-98275 (Patent Document 2) forms a thin part in a member of the fuel rail to prevent the breakage of the member by reducing stress that may be induced in the member by an assembling error when the fuel injection nozzle is connected to the fuel rail.

Patent Document 1: Jpn. Pat. No. 3385415

Patent Document 2: JP-A 2005-98275

A fuel injection nozzle for a direct injection system is screwed in an injector hole formed in the cylinder head of an internal combustion engine. The fuel injection nozzle is in direct contact with the cylinder head or in indirect contact with the cylinder head through a metal member having a comparatively large modulus of elasticity. The fuel injection nozzle is connected to a fuel pipe. The fuel pipe presses the fuel injection nozzle through an elastic member. The fuel injection nozzle is driven in a state where the pressure of the fuel (hereinafter, referred to as "fuel pressure") presses the fuel injection nozzle against the cylinder head while the engine is in operation.

The fuel injection nozzle generates sounds when the fuel injection nozzle is driven to open and close the nozzle valve. The generated sounds cause the valve body of the fuel injection nozzle to vibrate in directions parallel to the axis of the nozzle valve. As mentioned above, the fuel injection nozzle is pressed against the cylinder head by a force acting in a direction parallel to the axis of the nozzle valve. Both the cylinder head and the component members of the fuel injection nozzle are made of metals, in which sounds propagate at nearly equal velocities, and sound waves propagate easily through the cylinder head and the fuel injection nozzle. Thus the sound generated by the fuel injection nozzle propagates easily to the cylinder head. Sounds propagated to the cylinder head vibrate the cylinder head and devices attached to the cylinder head to generate noise. Therefore, it is desirable that the fuel injection nozzle and the cylinder head have greatly different moduli of elasticity, respectively, or that the fuel injection nozzle is connected through a member in which sounds propagate at a velocity different from a velocity in which sounds propagate in the fuel injection nozzle to the cylinder head.

A method of attaching the fuel injection nozzle to the cylinder head such that the fuel injection nozzle is not in contact with the cylinder head with respect to a direction parallel to the axis of the nozzle valve and a method of attaching the fuel injection nozzle through a substance having low rigidity, in which sounds propagate at a low velocity, to the cylinder head are effective in attaching the fuel injection nozzle to the cylinder head in the forgoing mode. This method needs to use a fuel rail for fixating the fuel injection nozzle. The fuel rail is fixed to the cylinder head, the fuel injection nozzle is fixed to the fuel rail, and a sealing member for sealing the gap between the fuel injection nozzle and the cylinder head to prevent the leakage of combustion gas is put on an end part of the fuel injection nozzle to form a shaft seal part.

When the fuel injection nozzle is thus fixed to the fuel rail, a fixing member for fixating the fuel injection nozzle needs to bear force produced by the fuel pressure. Therefore, the fixing member needs to have high strength. The fuel rail, as compared with the fuel injection nozzle, is a highly rigid member. Therefore, the fuel injection nozzle is attached rigidly to the fuel rail.

There is an error between the position of a mounting hole formed in the fuel rail to receive the fuel injection nozzle and the position of a mounting hole formed in the cylinder head to receive the fuel injection nozzle. It is not easy to form the mounting hole for receiving the fuel injection valve in the fuel rail manufactured by welding steel members at a desired position in high accuracy as compared with forming the mounting hole which can be formed at a desired position in the cylinder head usually by machining in high accuracy.

Consequently, the fuel injection nozzle is fitted in the mounting hole of the cylinder head and mounting hole of the fuel rail which are not aligned with each other. Therefore, when the sealing member put on the end part of the fuel injection nozzle on the side of the nozzle hole of the fuel injection nozzle rigidly attached to the fuel rail is fitted in the mounting hole of the cylinder head, the front end part of the fuel injection nozzle is displaced forcibly relative to the mounting hole of the fuel rail.

Thus, a bending moment acts on the fuel injection nozzle and deforms the fuel injection nozzle forcibly. Consequently, it is possible that internal parts of the fuel injection nozzle holding movable members are deformed affecting the characteristics of the fuel injection nozzle including injection volume.

If the walls of the internal parts holding the movable members are formed in a sufficiently big thickness to avoid such troubles, those parts will be forcibly displaced and other members will be deformed. The fuel injection nozzle defines a fuel passage for carrying the fuel to the nozzle hole of the fuel injection nozzle. Therefore, the fuel injection nozzle needs to be designed so as to withstand the fuel pressure. If members other than the internal movable members of the fuel injection nozzle are formed so as to be deformable, an excessively high stress is induced in the deformed members. Consequently, the members are liable to be broken and cannot withstand a high fuel pressure.

The foregoing problems will not arise if the fuel rail is formed sufficiently accurately. However, an accurate fuel rail is difficult to manufacture and is very expensive.

The high-pressure fuel pipe fastening method disclosed in Jpn. Pat. No. 3385415 uses a soft material and a hard material in combination for fastening the high-pressure fuel pipe and tapers an end part of the pipe to form a plastically deformable part to ensure a fuel sealing effect even if the fuel pipe is not aligned with the tapered fuel port formed in the device. However, nothing is disclosed in Jpn. Pat. No. 3385415 about the effect of the fastening part and the forcible displacement or deformation on the body of the fuel injection nozzle.

The method disclosed in JP-A 2005-98275 forms a part having a small wall thickness in the fuel rail to absorb deformation in the fuel rail. However, a method of ensuring strength sufficient to withstand fuel pressure and absorbing deformation is not satisfactorily taken into consideration.

SUMMARY OF THE INVENTION

Accordingly, it is an object of the present invention to provide a method of rigidly fastening a fuel injection nozzle to a fuel rail and a structure for carrying out the method without affecting principal parts of the fuel injection nozzle dominating the injection characteristics of the fuel injection nozzle.

The present invention provides a fuel injection nozzle for injecting fuel directly into a cylinder of an internal combustion engine, inserted in a fuel rail and fastened to the fuel rail with a fastening member, having a sealing part for sealing a fuel passage to prevent fuel leakage, and a contact part in contact with the fastening member; wherein the contact part is softer than the fastening member, and the contact part undergoes plastic deformation when a bending moment that bends the axis of the fuel injection nozzle acts on the fuel injection nozzle.

Preferably, the contact part is formed of a material having a tensile strength lower than that of the fastening member or a material having a hardness lower than that of the fastening member. Preferably, the contact part is a protrusion capable of coming into contact with the fastening member. Preferably, the contact part is a U-shaped member made of a material having a yield point lower than those of the fastening member and a fixing part of the fuel injection nozzle fixed by the fastening member, and held between the fastening member and the fixing part.

The present invention provides a fuel injection nozzle holding method of holding a fuel injection nozzle for injecting fuel directly into a cylinder of an internal combustion engine, including the steps of: inserting a base end part of the fuel injection nozzle in a fuel rail; and fastening the fuel injection nozzle to the fuel rail with a fastening member; wherein the fuel injection nozzle has a sealing part for sealing a fuel passage to prevent fuel leakage, and a contact part in contact with the fastening member, the contact part is formed in a member softer than the fastening member, and the contact part undergoes plastic deformation when a bending moment that bends the axis of the fuel injection nozzle acts on the fuel injection nozzle.

The fastening member may include a fixing clip, and a holding plate held between the fixing clip and the fuel injection nozzle.

According to the present invention, the fuel injection nozzle can be fastened to and held on the high-pressure fuel rail without affecting the performance of principal parts dominating the injection characteristic of the fuel injection nozzle even if the respective positions of the mounting part of the cylinder head and that of the fuel rail are not aligned because the contact part with which the fastening member engages is capable of plastic deformation.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Preferred embodiments of the present invention will be described.

First Embodiment

Figure 1:
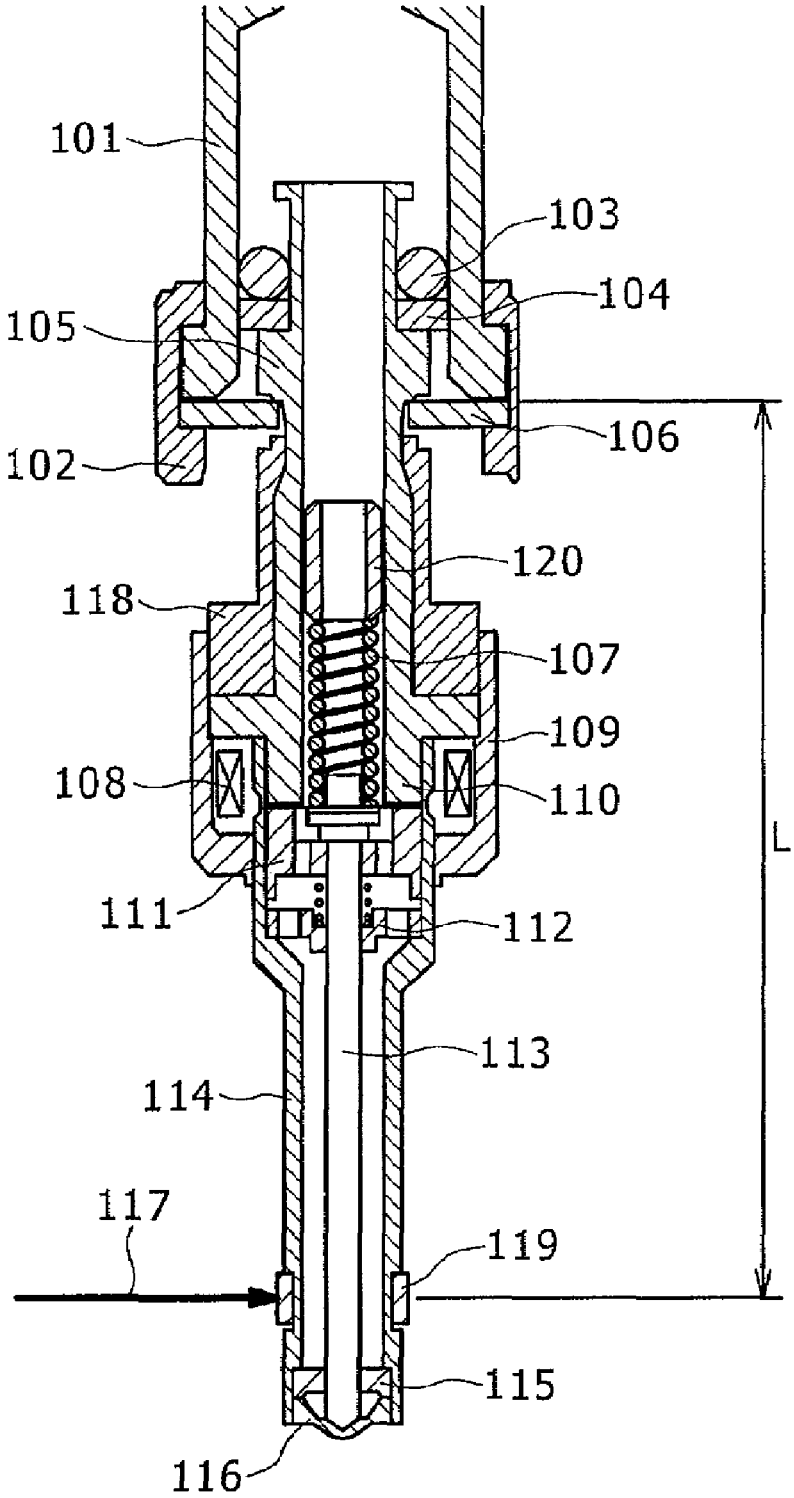
FIG. 1 is a longitudinal sectional view of a fuel injection nozzle in a first embodiment according to the present invention.
Figure 2:
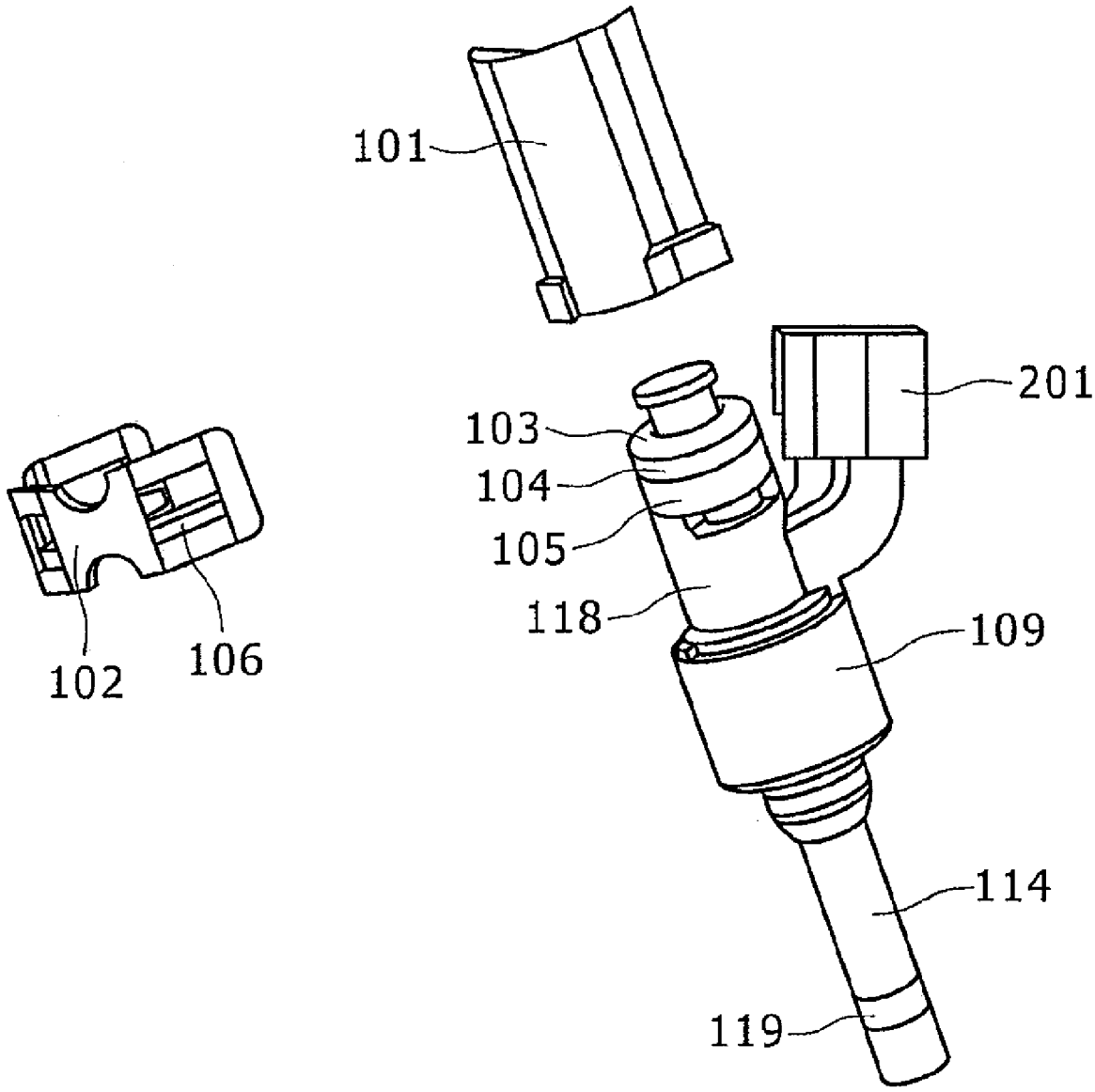
FIG. 2 is a perspective view showing component parts of the fuel injection nozzle in the first embodiment.
Figure 3:
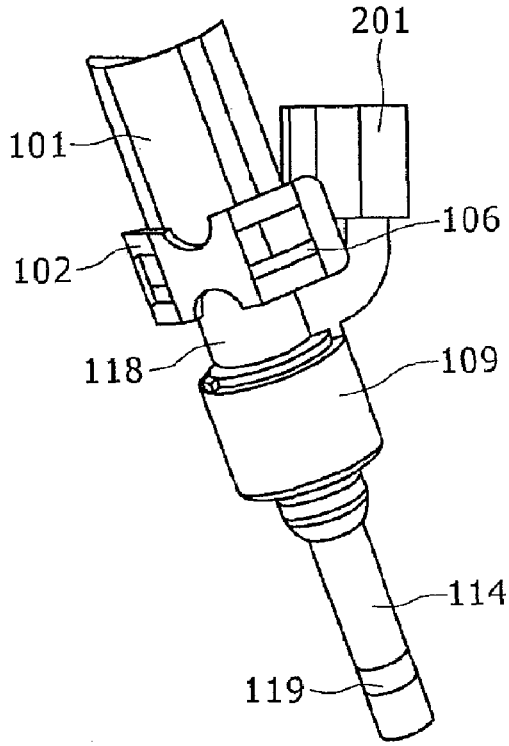
FIG. 3 is a perspective view of the fuel injection nozzle in the first embodiment in an assembled state.

FIG. 1 is a longitudinal sectional view of a fuel injection nozzle in a first embodiment according to the present invention, FIG. 2 is a perspective view showing a fuel rail 101, a fixing clip 102 and the fuel injection nozzle in the first embodiment in a disassembled state, and FIG. 3 is a perspective view of the fuel injection nozzle in the first embodiment in an assembled state. FIG. 1 is a sectional view taken from the side of a connector 201 through which power is supplied to a coil 108. Shown in FIG. 1 are a connecting pipe connecting the fuel injection nozzle to a high-pressure fuel rail, the fixing clip 102 and a holding plate 106 for fixing the fuel injection nozzle to the connecting pipe 101, an O ring 103 for sealing the fuel in the connecting pipe 101, and a backup spring 104.

When the fuel is supplied into the connecting pipe 101, the O ring 103 is pressed against the backup ring 104 by the fuel pressure so as to press a fixing ring 105 against a joining part of the fuel injection nozzle. Consequently, a force acts on the fuel injection nozzle so as to push the fuel injection nozzle in a direction away from the connecting pipe 101. This force is born by the fixing clip 102 and the holding plate 106 to restrain the fuel injection nozzle from being pushed away from the connecting pipe 101.

Thus, the nozzle body 109 of the fuel injection nozzle is not rigidly fixed to a cylinder head. Therefore, the direct propagation of percussive sounds generated by percussion between an anchor 111 and a core 110 and between a nozzle valve 113 and an orifice plate 116 to the cylinder head can be prevented. Generally, sounds can easily propagate from a rigid object in which sounds propagate at a high velocity to a soft object in which sounds propagate at a low velocity and it is difficult for sounds to propagate from a soft object to a hard object. Thus, the foregoing method of connecting the fuel injection nozzle to the cylinder head can prevent the propagation of operating sounds of the fuel injection nozzle to the cylinder head.

A nozzle tip part provided with a sealing member 119 of the fuel injection nozzle is inserted in a nozzle receiving hole formed in the cylinder head. The sealing member 119 put on the nozzle tip part of the fuel injection nozzle is fixedly pressed against the cylinder head in the direction of the arrow 117. When the connecting pipe 101 and the nozzle receiving hole are not aligned, the cylinder head applies a force in the direction of the arrow 117 to the fuel injection nozzle and, consequently a bending moment acts on the fuel injection nozzle.

The fixing clip 102 and the holding plate 106 fixedly holding the fuel injection nozzle are made of materials having high strength, respectively, so that the fixing clip 102 and the holding plate 106 may not be broken by a force exerted thereon by the fuel injection nozzle pressed by the fuel pressure. When the fuel pressure acts on the fuel injection nozzle, the fuel injection nozzle is pressed against the holding plate 106 and is rigidly fastened to the connecting pipe 101 by the fixing clip 102.

Driving members of the fuel injection nozzle are disposed on the downstream side of an adjusting pin 120 and a spring 107. The nozzle valve 113 opens and closes to start and to stop fuel injection. The axial sliding movement of the nozzle valve 113 is guide by an upper rod guide 112 and a lower nozzle valve guide 115. The rod guide 112 and the nozzle valve guide 115 are fixed to a nozzle holder 114.

Valve opening force for opening the nozzle valve 113 is magnetic attractive force acting between the anchor 111 and the core 110 when the coil 108 is energized. The valve opening force is transmitted through a contact part 121 between the anchor 111 and the nozzle valve 113. Valve closing force for closing the nozzle valve 113 is the resilient force of the spring 107 compressed by an adjuster 120. When power supplied to the coil 108 is cut, the resilient force of the spring 107 moves the nozzle valve 113 in the closing direction to close the fuel injection nozzle by seating the nozzle valve 113 on a valve seat formed in the orifice plate 116.

The fuel injection nozzle has the foregoing construction. When the members, such as the nozzle holder 114, the nozzle body 109 and the core 110, on the downstream side of the adjuster 120 are deformed, the rod guide 112 and the valve guide 115 are dislocated. Consequently, it is possible that the operation of the nozzle valve 113 after those members have been deformed is different from that of the nozzle valve 113 before the deformation of those members.

In the fuel injection nozzle in the first embodiment, a small protrusion is formed in the interface between the fixing ring 105 and the holding plate 106. Preferably, the fixing ring 105 is made of a material, such as a ferritic stainless steel or an austenitic stainless steel, softer than the materials of the fixing clip 102 and the holding plate 106, namely, a material having a low yield point. When the fuel injection nozzle has such construction, the deformation of the members on the downstream side of the adjuster 120 is prevented by the effects which will be described later. Desirably, the fixing ring 105 is made of a material softer than those of the holding plate 106 and the fixing clip 102 and hence it is desirable that the thickness of the fixing ring 105 along the axis of the fuel injection nozzle is greater than those of the holding plate 106 and the fixing clip 102. When the fixing clip 102, the holding plate 106 and the fixing ring 105 have such thicknesses, respectively, the breakage of any one of the fixing clip 102, the holding plate 106 and the fixing ring 105 can be prevented.

Figure 4:
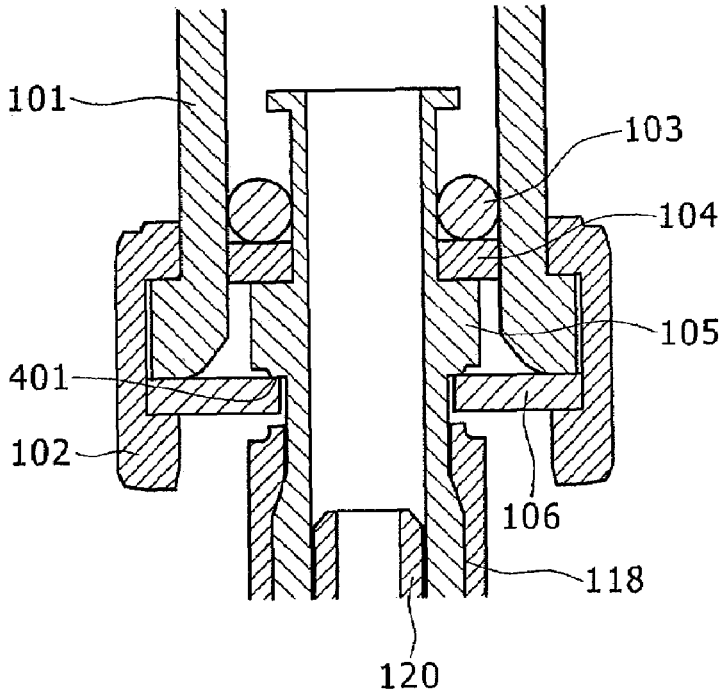
FIG. 4 is an enlarged, longitudinal sectional view of an end part of the fuel injection nozzle in the first embodiment on the side of a fuel rail.

FIG. 4 is a longitudinal sectional view of a base end part of the fuel injection nozzle around the fixing ring 105 near the joint of the fuel injection nozzle and the connecting pipe 101. As shown in FIG. 4, a small protrusion 401 protrudes from a surface of the fixing ring 105 facing the holding plate 106. Since the small protrusion 401 is made of a material having a yield point lower than that of the material of the holding plate 106 in contact with the fixing ring 105, the small protrusion 401 undergoes plastic deformation before the holding plate 106 when a high force is exerted thereon.

Figure 5:
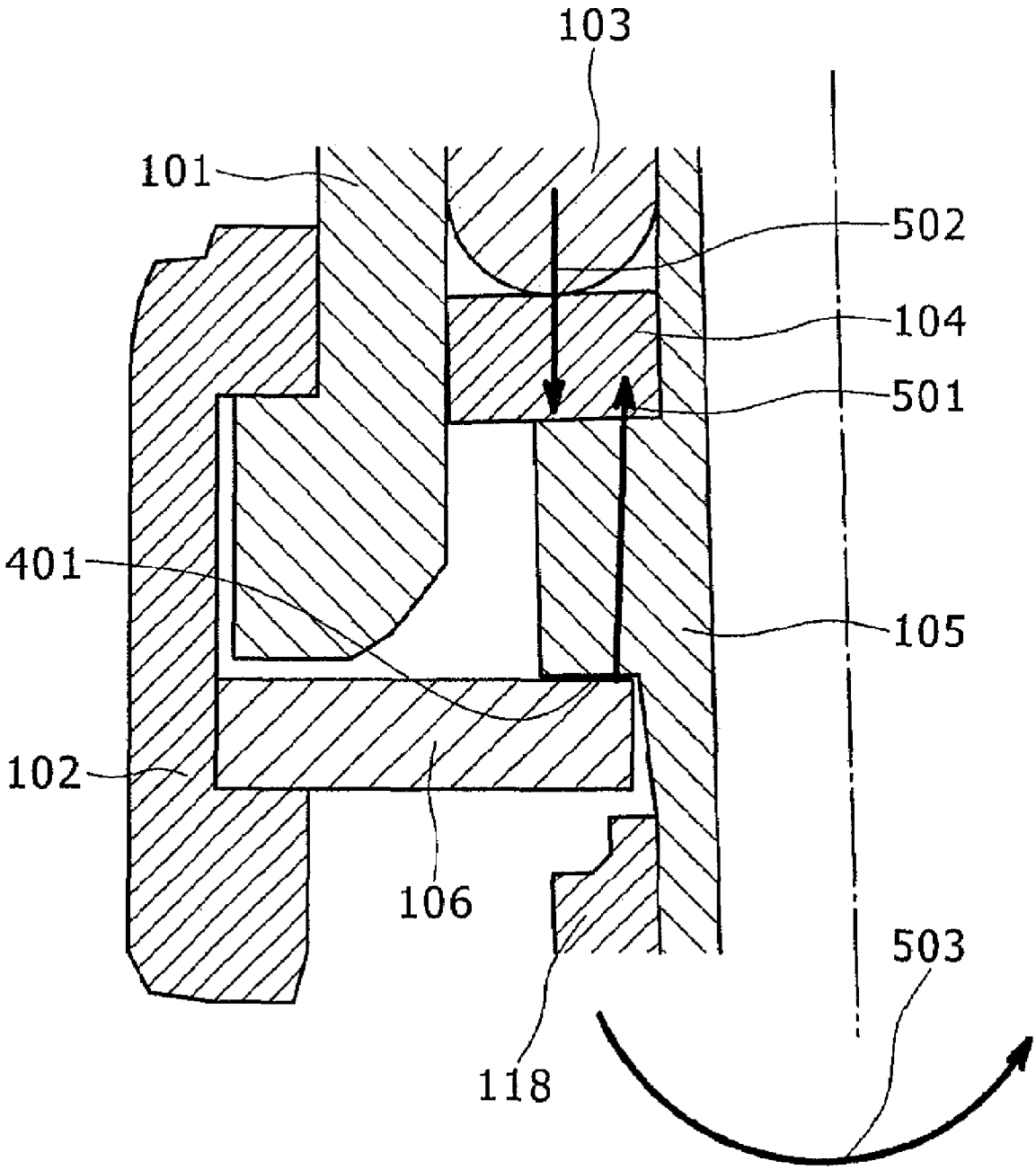
FIG. 5 is an enlarged, half sectional view of assistance in explaining force and moment that act on the end part of the fuel injection nozzle in the first embodiment, moment and the deformation of the end part.

FIG. 5 illustrates a state where the small protrusion 401 in contact with the holding plate 106 has undergone plastic deformation, and forces acting on the members. FIG. 5 shows the fuel injection nozzle in a tilted position in an exaggerated drawing. When the fuel pressure exerts a force indicated by the arrow 502 through the O ring 103 and the backup ring 104 on the fuel injection nozzle, a force indicated by the arrow 501 acts on the fuel injection nozzle. The force indicated by the arrow 501 are born by the fixing ring 105, the holding plate 106 and the fixing clip 102 to fix the fuel injection nozzle to the connecting pipe 101.

When the connecting pipe 101 and the nozzle receiving hole formed in the cylinder head to receive the tip end part provided with the sealing member 119 are not aligned, the force indicated by the arrow 117 shown in FIG. 1 acts on the tip end part of the fuel injection nozzle due to forced displacement. Consequently, a bending moment indicated by the arrow 503 acts on the fuel injection nozzle, and the vector sum of a force indicated by the arrow 502 generated by the fuel pressure and a force generated by the bending moment indicated by the arrow 503 acts on the small protrusion 401.

Since the small protrusion 401 is made of a material having a yield point lower than that of the holding plate 106, the small protrusion 401 undergoes plastic deformation before the holding plate 106 yields. The magnitude of the plastic deformation is large in parts on which a large vector sum of the force generated by the fuel pressure and the force generated by the bending moment acts. Consequently, the fuel injection nozzle is tilted relative to the cylinder head by the bending moment produced by forced displacement. The amount of forced displacement resulting from the misalignment of the connecting pipe 101 and the nozzle receiving hole is absorbed by the tilt of the fuel injection nozzle. Consequently, the bending moment acting on the fuel injection nozzle reduces. Preferably, the small protrusion 401 is tapered. When the small protrusion 401 is tapered, contact area increases as the small protrusion 401 is deformed plastically and force counteracting the bending moment increases gradually.

Since the small protrusion 401 that deforms to reduce the bending moment is nearer to the connecting pipe 101 than the adjuster 120, the small protrusion 401 can be separated a long distance L (FIG. 1) from the nozzle tip end part provided with the sealing member 119 that is forcibly displaced. Therefore, stress induced in the fuel injection nozzle by the forced displacement caused by the force acting in the direction of the arrow 117 can be reduced by the slight deformation of the small protrusion 401. Since the deformable part is nearer to the connecting pipe 101 than the adjuster 120, the bending moment resulting from the force displacement can be reduced without affecting the nozzle valve 113, the guides 112 and 115 and the movable anchor 111, which are functional components of the fuel injection nozzle.

Even if the fuel injection nozzle is displaced forcibly in the direction of the arrow 117, a part of the small protrusion 401 deforms plastically to reduce the bending moment and thereby the deformation of a part of the fuel injection nozzle holding the functional members of the fuel injection nozzle, namely, a part of the fuel injection nozzle on the downstream side of the adjuster 120, can be prevented. Therefore, even if the connecting pipe 101 and the nozzle receiving hole formed in the cylinder head are not aligned, the fuel injection nozzle can be attached to the cylinder head without adversely affecting the functions of the fuel injection nozzle. Since the materials of the holding plate 106 and the fixing clip 102 are selectively determined such that the respective yield points of the holding plate 106 and the fixing clip 102 are higher than that of the small protrusion 401, the holding plate 106 and the fixing clip 102 can be strengthened so that the holding plate 106 and the fixing clip 102 can withstand higher fuel pressure. Since only the small protrusion 401 needs to be deformed, the fixing ring 105 can be formed in a sufficiently big thickness and can be designed so that the fixing ring 105 may not be broken.

When the fuel injection nozzle is thus fixed to the connecting pipe 101, the holding plate 106 and the fixing clip 102 can be sufficiently strengthened and the functions of the fuel injection nozzle will not be deteriorated even if the connecting pipe 101 and the nozzle receiving hole are not aligned. Since the plastically deformable small protrusion 401 is apart from the sealing member, the sealing property (leakage preventing property) of the fuel injection nozzle will not be affected by the plastic deformation of the small protrusion 401. Since a wall defining a fuel passage does not need to be formed in a small thickness, the fuel injection nozzle can be applied to a direct injection type engine required to use high fuel pressure. It is possible to reduce the possibility of the deformation and breakage of the members caused by the misalignment of the connecting pipe and the nozzle receiving hole formed in the cylinder head causing fuel leakage.

Figure 9:
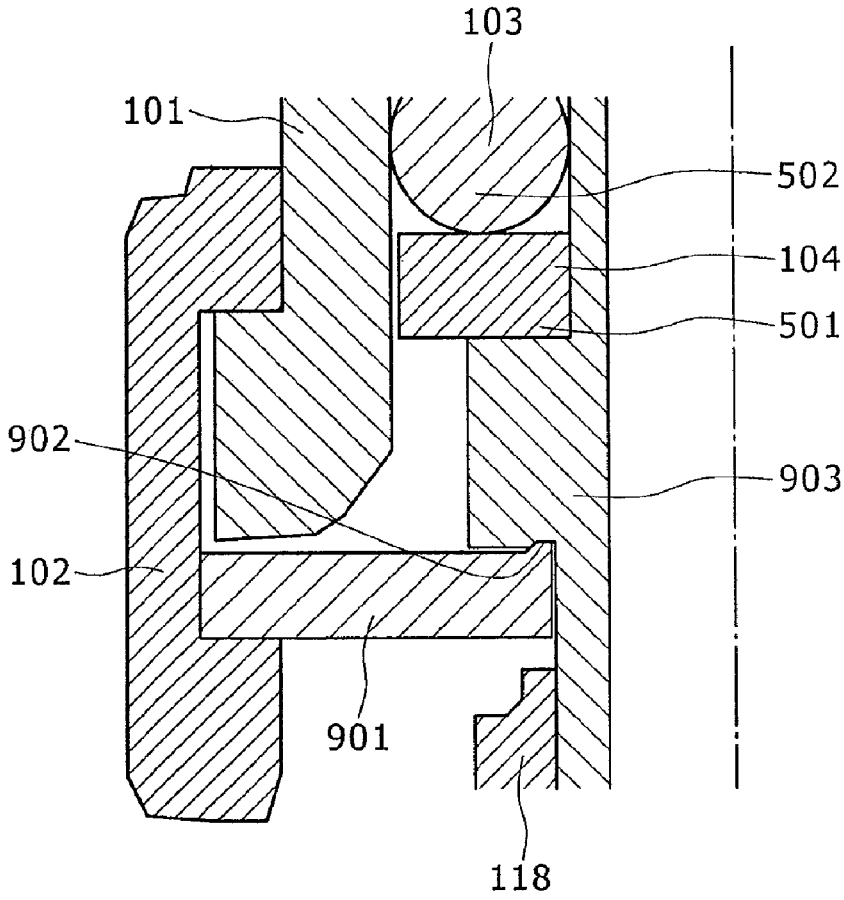
FIG. 9 is an enlarged half sectional view of the end part of the fuel injection nozzle in the first embodiment on the side of the fuel rail, in which a protrusion is formed in a holding plate.

The foregoing effect can be exercised also by forming a small protrusion 902 in a holding plate 901 as shown in FIG. 9. When the small protrusion 902 is formed in the holding plate 901, a fixing ring 903 made of a soft material undergoes plastic deformation, so that actions and effects similar to those of the fuel injection nozzle shown in FIG. 1 using the fixing ring 104 provided with the small protrusion can be exercised.

Figure 10:
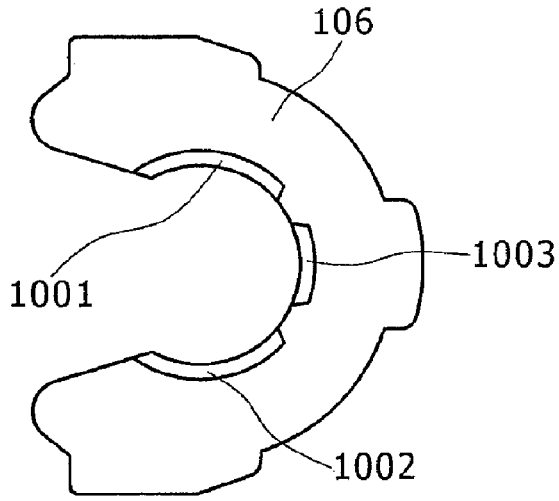
FIG. 10 is a plan view of the holding plate shown in FIG. 9 taken from the side of a fixing ring.

In either case, the small protrusion does not necessarily need to be a circumferentially continuous protrusion. FIG. 10 is a plan view of a holding plate 901 provided with a circumferentially discontinuous small protrusion taken from the side of a fixing ring 903. Even if the circumferentially discontinuous small protrusion cannot be formed in a satisfactorily small width, pressure acting on a part of the circumferentially discontinuous small protrusion can be increased. Therefore, the forced displacement resulting from the misalignment of the connecting pipe and the nozzle receiving hole of the cylinder head can be absorbed to reduce the bending moment by subjecting the member made of a soft material to plastic deformation.

Thus the fuel injection nozzle can be fixed to the connecting pipe by a fixing method capable of preventing the propagation of sounds generated by the operating fuel injection nozzle to the cylinder head without deteriorating the functions of the fuel injection nozzle. The present invention does not need a highly accurate fuel train and can suppress a big increase of the cost.

Second Embodiment

Figure 6:
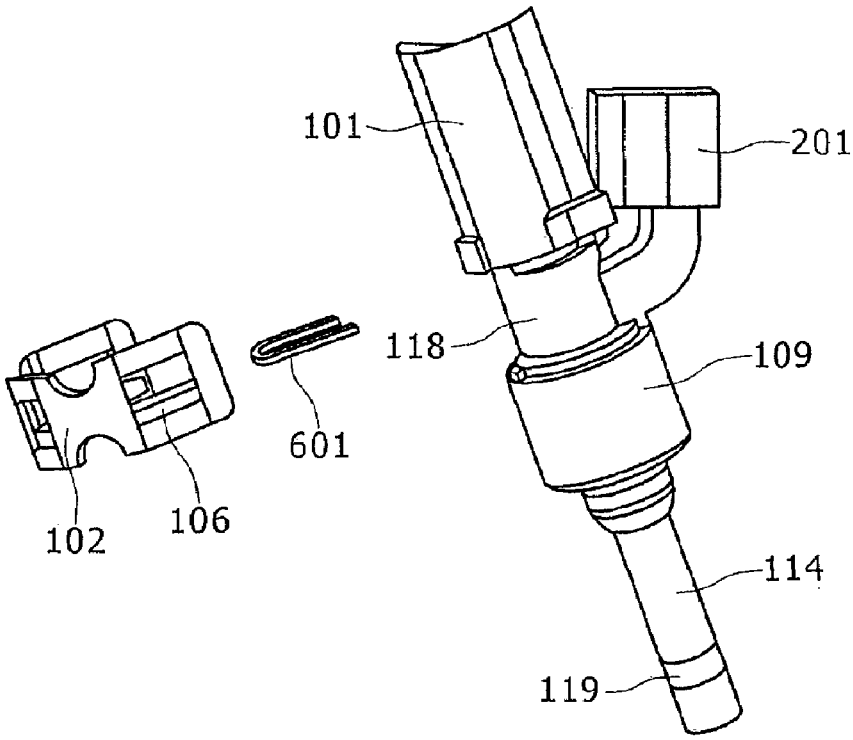
FIG. 6 is an exploded perspective view of a fuel injection nozzle in a second embodiment according to the present invention.
Figure 7:
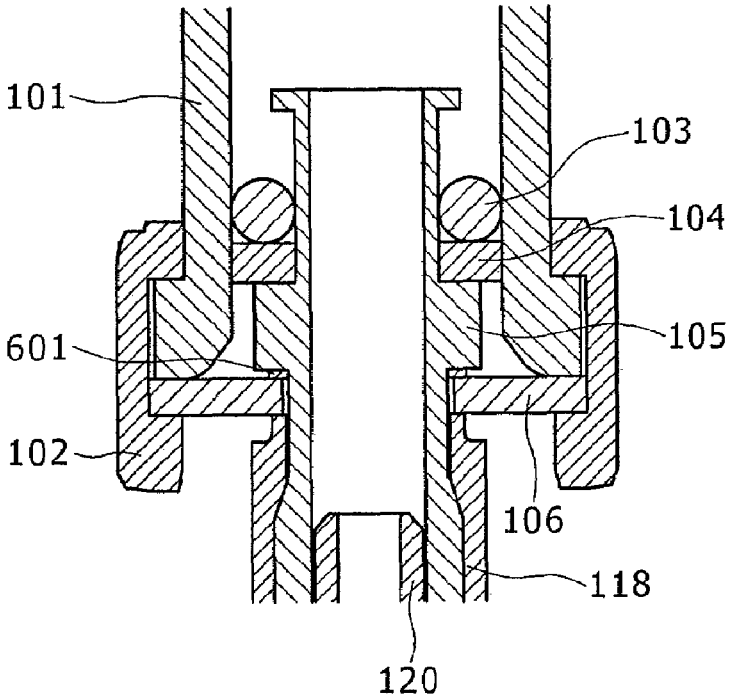
FIG. 7 is an enlarged, longitudinal sectional view of an end part of the fuel injection nozzle in the second embodiment on the side of a fuel rail.

FIG. 6 is a perspective view of a fuel injection nozzle in a second embodiment according to the present invention provided with a U-shaped deformable member 601, namely, a detachable, plastically deformable member. The deformable member 601 is made of a material having a yield point lower than that of a holding plate 106 and is held between the fuel injection nozzle and the holding plate 106. FIG. 7 is a longitudinal sectional view of a base end part of the fuel injection nozzle provided with the deformable member 601 near the joint of the fuel injection nozzle and a connecting pipe 101 taken from the side of a connector 201 (FIG. 6).

The deformable member 601 exercises the same effect as the protrusion 101 of the fuel injection nozzle in the first embodiment. Thus the second embodiment is the same as the first embodiment in effect.

Since the deformable member 601 has the U-shape, the deformable member 601 can be inserted into the fuel injection nozzle in a process of connecting the fuel injection nozzle to a fuel rail.

The plastic deformation of the fuel injection nozzle can be prevented by using the plastically deformable member separate from the fuel injection nozzle. The body of the fuel injection nozzle will not be deformed when the fuel injection nozzle or a pipe needs to be removed. Therefore, only the deformable member 601 may be changed. Desirably, the deformable member 601 is made of a material having a yield point lower than not only the material of the holding plate 106, but also the material of the fixing ring 105. When those members are in such a relation in yielding point, an expected effect can be exercised without damaging both the fuel injection nozzle and the holding plate 106.

Third Embodiment

Figure 8:
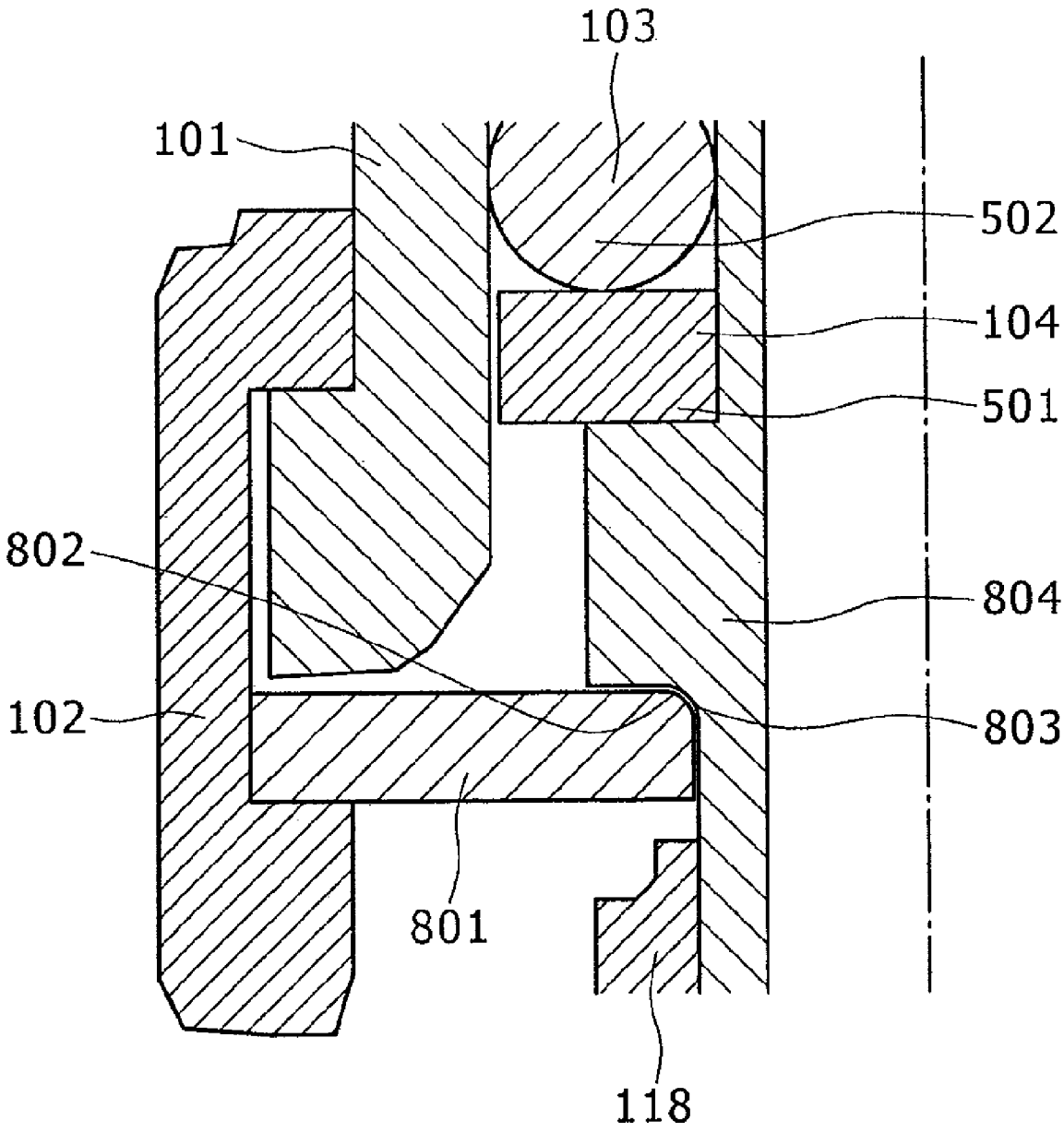
FIG. 8 is an enlarged, half sectional view of an end part of a fuel injection nozzle in a third embodiment according to the present invention on the side of a fuel rail.

FIG. 8 is a fragmentary, half sectional view of a fuel injection nozzle in a third embodiment according to the present invention. FIG. 8 shows a connecting pipe 101 and a base end part of the fuel injection nozzle around a connecting pipe 101. In the third embodiment, an outer corner of a holding plate 801 contiguous with a fixing ring 804 is rounded in a rounded corner 802. An inner corner of the fixing ring 804 contiguous with the holding plate 801 is rounded in a rounded corner 803. The radius of the rounded corner 802 is smaller than that of the rounded corner 803. Since the outer corner of the holding plate 801 is rounded in the rounded corner 802, and the inner corner of the fixing ring 804 corresponding to the outer corner of the holding plate 801 is rounded in a rounded corner 803, The holding plate 801 and the fixing ring 804 are in line contact with each other. A high stress is induced in a part of the fixing ring 801 made of a soft material in line contact with the curved corner 803 of the fixing ring 804, and the fixing ring 801 made of the soft material undergoes plastic deformation. Since the radius of the rounded corner 802 is smaller than that of the rounded corner 803, the fuel injection nozzle, similarly to the fuel injection nozzle in the first embodiment provided with the small protrusion, can exercise an effect of absorbing bending moment by tilting itself even if the connecting pipe 101 and the nozzle receiving hole formed in the cylinder head are not aligned.

What is claimed is:

1. A fuel injection nozzle for injecting fuel directly into a cylinder of an internal combustion engine, inserted in a fuel rail and fastened to the fuel rail with a fastening member, said fuel injection nozzle having:

a sealing part for sealing a fuel passage to prevent fuel leakage; and a contact part in contact with the fastening member;

wherein the contact part is softer than the fastening member, and the contact part undergoes plastic deformation when a bending moment that bends the axis of the fuel injection nozzle acts on the fuel injection nozzle.

2. The fuel injection nozzle according to claim 1 wherein the contact part is formed of a material having a tensile strength lower than that of the fastening member or a material having a hardness lower than that of the fastening member.

3. The fuel injection nozzle according to claim 1, wherein the contact part is a protrusion capable of coming into contact with the fastening member.

4. The fuel injection nozzle according to claim 1, wherein the contact part is a U-shaped member made of a material having a yield point lower than those of the fastening member and a fixing part of the fuel injection nozzle fixed by the fastening member, and held between the fastening member and the fixing part.

5. A fuel injection nozzle holding method of holding a fuel injection nozzle for injecting fuel directly into a cylinder of an internal combustion engine, comprising the steps of:

inserting a base end part of the fuel injection nozzle in a fuel rail; and fastening the fuel injection nozzle to the fuel rail with a fastening member;

wherein the fuel injection nozzle has a sealing part for sealing a fuel passage to prevent fuel leakage, and a contact part in contact with the fastening member, the contact part is formed in a member softer than the fastening member, and the contact part undergoes plastic deformation when a bending moment that bends the axis of the fuel injection nozzle acts on the fuel injection nozzle.

6. The fuel injection nozzle holding method according to claim 5, wherein the fastening member includes a fixing clip, and a holding plate held between the fixing clip and the fuel injection nozzle.

* * * * *